US011325006B2

(12) United States Patent
Billeaudeaux et al.

(10) Patent No.: US 11,325,006 B2
(45) Date of Patent: May 10, 2022

(54) SURFING GLOVE

(71) Applicants: Michael Billeaudeaux, Annandale, VA (US); John Comiskey, Bayside, NY (US); Michael Larranaga, Coppell, TX (US)

(72) Inventors: Michael Billeaudeaux, Annandale, VA (US); John Comiskey, Bayside, NY (US); Michael Larranaga, Coppell, TX (US)

( * ) Notice: Subject to any disclaimer, the term of this patent is extended or adjusted under 35 U.S.C. 154(b) by 106 days.

(21) Appl. No.: 16/821,468

(22) Filed: Mar. 17, 2020

(65) Prior Publication Data

US 2020/0306591 A1 Oct. 1, 2020

Related U.S. Application Data

(60) Provisional application No. 62/823,018, filed on Mar. 25, 2019.

(51) Int. Cl.

| | |
|---|---|
| ***A63B 31/04*** | (2006.01) |
| ***A63B 69/00*** | (2006.01) |
| ***A63B 31/10*** | (2006.01) |

(52) U.S. Cl.

CPC ..... *A63B 31/04* (2013.01); *A63B 31/10* (2013.01); *A63B 69/0093* (2013.01)

(58) Field of Classification Search

CPC ..... A63B 31/00; A63B 31/02; A63B 31/04; A63B 31/08; A63B 31/10; A63B 69/0093; A63B 71/141; A63B 71/143; A63B 71/145; A63B 71/146; A63B 71/148; A41D 19/00; A41D 19/01523; A41D 19/01547; A41D 19/01558; A41D 19/01564

See application file for complete search history.

(56) References Cited

U.S. PATENT DOCUMENTS

| | | | | |
|---|---|---|---|---|
| 458,888 | A | 9/1891 | Eisele | |
| 1,437,310 | A | 11/1922 | Ingram | |
| 1,669,010 | A | 5/1928 | Fritz | |
| 1,746,268 | A | 2/1930 | Louis | |
| 3,231,910 | A | 2/1966 | Tegland | |
| 4,027,347 | A | 6/1977 | Sato | |
| 4,071,913 | A * | 2/1978 | Rector | A41D 19/01523 2/20 |

(Continued)

FOREIGN PATENT DOCUMENTS

AU 2008100386 A4 5/2008

*Primary Examiner* — Ajay Vasudeva

(57) ABSTRACT

Enhanced surfing by means of waterproof gloves which provide lifting pads spanning the width of the palm from the base of the thumb and terminating near the pinky, or also extending across the upper palm finger pads if desirable, while secured tightly at the wrist. The padding is contoured and rises to prescribed height starting at the base of the wrist, rising to the maximum height near the base of the palm, and then returning to 'level' with the hand inside the palm. Similarly, narrower finger pads will follow a similar contour but will have less height than the palm pad. The padding provides a resilient, rebound boost to aid surfers in quickly rising to their feet while simultaneously creating more clearance between a surfer's torso and board to allow for a heightened swing arch to create forward distance for initial foot positioning and added takeoff momentum.

5 Claims, 2 Drawing Sheets

(56) References Cited

U.S. PATENT DOCUMENTS

| | | | | | |
|---|---|---|---|---|---|
| 4,546,495 | A * | 10/1985 | Castillo | A41D 19/01523 | 482/106 |
| 4,624,016 | A * | 11/1986 | Luevano | A41D 19/01523 | D29/117.1 |
| 4,691,387 | A * | 9/1987 | Lopez | A63B 71/141 | 2/160 |
| 4,738,447 | A * | 4/1988 | Brown | A63B 71/148 | 473/450 |
| 4,747,163 | A * | 5/1988 | Dzierson | A41D 19/01523 | 2/164 |
| 5,214,799 | A * | 6/1993 | Fabry | A41D 19/01523 | 2/161.6 |
| 5,257,418 | A * | 11/1993 | Jaskiewicz | A41D 19/01523 | 2/161.1 |
| 6,088,835 | A | 7/2000 | Perkins et al. | | |
| 6,289,517 | B1 * | 9/2001 | Minkow | A41D 19/01523 | 2/161.1 |
| 6,845,519 | B2 * | 1/2005 | Garneau | A63B 71/141 | 2/161.1 |
| 8,082,601 | B2 * | 12/2011 | Yang | A63B 71/081 | 2/455 |
| 8,291,517 | B2 * | 10/2012 | Taliento | A41D 19/01547 | 2/163 |
| 8,769,721 | B2 * | 7/2014 | Wilbert | A41D 19/01523 | 2/161.1 |
| 9,888,734 | B2 | 2/2018 | Bevier et al. | | |
| 10,744,395 | B2 * | 8/2020 | Gonzalez | A63B 71/148 | |
| 2008/0092269 | A1 * | 4/2008 | Schox | A61F 5/0118 | 2/159 |
| 2015/0059043 | A1 | 3/2015 | Dwyer | | |

* cited by examiner

SURFING GLOVE

FIELD OF THE INVENTION

The invention relates generally to the sport of surfing, and more specifically, by providing an improved method of boosting a surfer's critical takeoff speed while providing more opportunity for a more-rapid prone to standing position through the assistance of a palm pad(s), greater height achieved between torso and board for allow for a greater legs/feet forward swing arch which provides for more immediate proper foot placement.

BACKGROUND OF THE INVENTION

Surfing relies on a combination of movements and techniques. The surfer must get away from the shore into an area where the waves are breaking, get positioned ahead of a breaking wave, and then rapidly stand on the board in the proper stance to force the back (also known as the "bottom") of the surfboard to push off the rising water, in what surfer's refer to as "trim" as in "to achieve trim is where hydrodynamic lift occurs and thus propel the surfer forward and down the face of a wave in synch with the wave's speed after achieving a proper stance and trim.

Swimming aids have been disclosed. For example, U.S. Pat. No. 458,888 (September 1891) teaches a swimming glove made from a mesh material with slots for the swimmer's fingers so as to form a webbed glove. Similarly, see U.S. Pat. No. 1,437,310 (November 1922); U.S. Pat. No. 1,669,010 (May 1928); U.S. Pat. No. 1,746,268 (September 1928); U.S. Pat. No. 3,231,910 (January 1964); and U.S. Pat. No. 4,027,347 (June 1977).

U.S. Pat. No. 6,088,835 (July 2000) describes a swimming glove that also has features said to be useful when surfing. These features include a variety of textured surface areas to enhance grip as well as drag when paddling out to a wave. On the back of the glove are a series of anchored dorsal chute sections that channel water and allow the user to maneuver more easily.

The prior art swimming gloves may enhance the ability of the surfer to paddle away from the shore to a wave or to swim back. None of the disclosed gloves appear to have features that facilitate the next part of the surfing process, namely, transitioning from prone to standing.

To achieve a quick and smooth takeoff, surfers rely on a moment of explosive strength, flexibility and agility to (1) leap immediately from a paddling to a standing position and then (2) gain immediate proper foot position. Immediate foot placement is very important for the gaining a board's "angle of attack" where a surfer's planted weight is not too far to the rear of the board so as to cause drag and achieve trim. If a surfer can leap up and immediately land with their feet in the right spot on first contact and without shuffling them forward, they will have achieved maximum hydrodynamic lift created by their surfboard so as to maintain their critical takeoff speed.

Beginner, older or out-of-shape surfers often struggle with both (1) leaping and (2) foot positioning during takeoffs. Both should be done quickly and under balanced control for best effect. Often, these surfers can only rise to their knees or bend over and hold their board while shuffling their feet to the proper surfboard position. Even advanced surfers seek to gain a competitive edge in this two-step process as fast-moving waves require a speedy and mistake-free takeoff where even the slightest failure in a big wave can be deadly.

For all surfers, when leaping or foot placement slows the takeoff process even for a second, enough of the peak of the wave passes under the struggling surfer so that if they do catch the wave at all, they often miss riding the desired unbroken "face" of the wave and are left with a chance of catching only the broken wave's "whitewater" if anything at all.

Gloves have been disclosed that have a wide variety of padding and gripping surfaces, often with the goal of enhancing the gripping force acting on a tool held by the gloved hand. For example, see U.S. Pat. No. 4,624,016 (athletic glove with leather palm region); U.S. Pat. No. 5,896,584 (sports glove with insertable pad for better gripping of generally cylindrical object), and published application US 2012-0316485 (padded cycling glove to enhance grip and dampen vibrations).

It would be desirable to have something that a surfer can use while surfing that would help the surfer to get up off the board and into a standing position.

It would also be desirable to have a surfing aid that was light, unharmed by exposure to salty water, and unlikely to be readily detached and lost.

SUMMARY OF THE INVENTION

It is an objective of the invention to provide a surfing aid that is used while surfing and that aids the surfer in the transition from prone to standing.

It is further an objective of the invention to provide a light weight, durable, surfing aid that is used while surfing.

In accordance with these and other objectives that will become apparent from the description herein, a surfing aid according to the invention includes a surfing glove having a palm side with a centrally-located palm region and a complementary exterior side, said glove comprising a resilient, deformable pad rising above a palm region of the glove a distance of 1-10 cm.

The glove of the present invention also provides a method for enhancing the transition from a prone position to a standing position while a user is surfing by: (a) compressing a resilient, deformable pad against an upper surface of a surf board to store potential energy in said resilient, deformable pad, and then (b) releasing said compression so as to release said potential energy and help propel said user into a standing position.

The elevated, resilient, pads on the palm of the glove provide a resilient, rebounding boost force from the stored potential energy of the compressive forces exerted by the surfer on the pads as the surfer begins to transition from prone to standing. As the surfer begins to move upwardly, the potential energy stored in the pads releases back onto the user's hands and provides a vertical lift boost that aids the surfer to more quickly rise to their feet. Simultaneously, the lift boost and beginning height from the elevated position of the pads help to create more clearance between a surfer's torso and board to allow for a heightened swing arch which creates more forward distance for initial foot positioning and added takeoff momentum. The net result is a surfing aid that can actually help surfers and would-be surfers to execute the movements and transitions necessary to ride a wave on a surfboard.

DETAILED DESCRIPTION OF THE INVENTION

Figure 1:
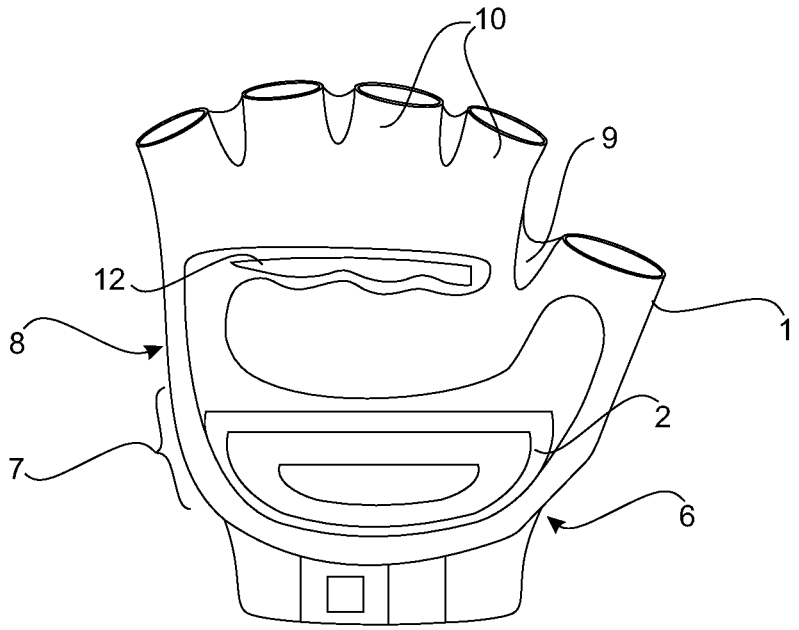
FIG. 1 shows a top view of a surfing glove with an elevated central ridge of according the invention.

This invention provides for gloves that allow a surfer to improve the process of taking off on a wave. The invention is a pair of gloves that provide a cushioned, resilient, semi-compressible or elastomeric, padding on the palms of each glove. As a surfer pushes down on the palm cushions, the padding deforms under the force and then rebounds that energy back to the surfer's hands and thereby provide a vertical boost of energy to accelerate a surfer's leap to their feet during takeoff. In effect, the glove of the present invention is merely a carrier for a resilient, rebound surface that a surfer can temporarily charge with compressive energy that is almost immediately used to push the surfer upward and into a standing position.

Thick padding also create additional height between a surfer and the board so as to create a taller "swing arch"—more under-torso clearance—for which a surfer can more easily flip their feet a greater distance forward. Achieving immediate forward footing is especially advantageous on longer surfboards which are also the preference of most beginning, arthritic or older surfers. The enhanced swing arch also allows for increased forward body momentum; useful as a surfer works to match and then maintain the speed of the moving wave during takeoff. Gaining initial proper footing, by reducing post take-off shifting of a surfer's feet, can expedite achieving hydrodynamic planning—or lift—thus creating more efficient acceleration into any wave.

The gloves of the present invention may not use the same height or span combination on each glove as some surfers may desire a custom combination. One such combination might have a larger palm cushion height on one glove relative to the opposite glove so as to enhance surfer's ability to slightly spin their body to enhance a takeoff favoring waves breaking left or right and depending on a surfer's natural inclination to be "Goofy-footed" (left foot planted rear of board) or "Sure-footed" (right foot planted on rear of board).

Finally, palm padding is designed to spring the user forward as they roll their raised palms past the peak of the palm pads, which will be higher than the optional base-of-the-finger pads, thus providing additional palm-based energy return on takeoff.

While an image of a cut away glove is provided in the figures to allow a surfer to have uncovered use of their fingers, a full fingered glove version (see FIG. 4) will allow for use in colder environments.

Surfing improvements can be achieved by all surfers though the wearing of gloves according to the present invention.

The resilient, compressible palm pad used in the present invention can be made from a wide variety of materials and structures. Suitable materials include high density foams, elastomers whether natural or synthetic, and air-filled bladders that contoured to the palm regions of the surfing gloves according to the invention. When a surfer pushes down on the pad against the surfboard, that energy provide the wearer what a sports-shoe manufacturer describe as delivering an 'explosive rebound' or 'energy transfer' effect to similarly help the terrestrial athlete jump higher. Thus, the palm-based—and finger pad-based in some variations—will boost the surfer in not only accelerating their prone-to-vertical leap, but the contoured pad's height(s) will also create more under-body clearance so as to increase the vertical space thus creating a higher "A-frame" style "swing arch" where a surfer's legs and feet will be able to travel further forward on the board. Gaining a more expedient foot position further forward on the board may also establish a more level takeoff to promote quicker hydrodynamic planning of surfboard. The shape of the glove's pads will provide a forward thrusting palm contour to help accelerate a surfer's weight forward to gain more momentum which is highly desirable to advanced or professional surfers especially when attempting to catch steep, fast-moving or "hallow" waves.

Specific details of certain embodiments of the invention are set forth in the figures to provide a more complete understanding of such embodiments.

FIG. 1 is a glove 1 according to the invention showing the approximate location, span and elevation of the palm's foam, rubber or air-filled palm pad 2 which gradually rises from the base glove 3 up to a given maximum height 4 at peak 5. The gradual rise from wrist end 6 up to its peak 5 in palm region 7 and then down to knuckle region 8 will allow for a smooth transition and comfort to the user while moving forward at takeoff. Interfinger webbing 9 promotes a stronger, more efficient paddle stroke. Half-length finger slots 10 are shown although it will be understood that a version with full length fingers can also be used for greater warmth, protection, and/or grip.

Figure 2:
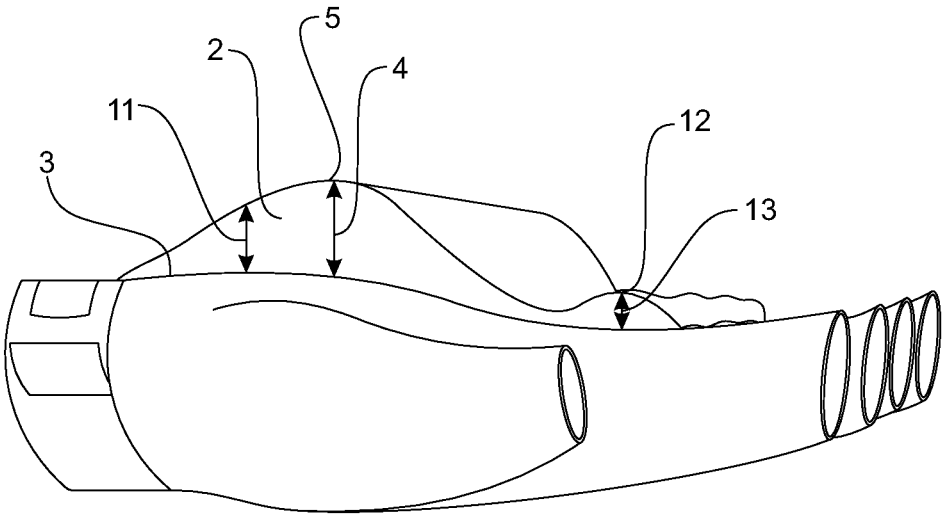
FIG. 2 illustrates a side view of a surfing glove according to the invention.

FIG. 2 is a thumb side view of a surfing glove according to the invention. As shown, palm pad 2 exhibits a gradually sloping rise 11 from the wrist portion 6 of the base glove 3 to its peak 5 at height 4. Rise 11 can be straight (such as at an angle within the range of 5-45°, preferably within the range of 15-30°) relative to the plane of the base glove's central palm region 7), curved, or waffled with a combination of flat and curved portions but generally exhibiting a continuing rise to peak 5.

Palm pad 2 preferably extends substantial distance across the palm region 7 of glove 1 even if tapering down to the base glove at the outside edges of palm region 7. Even more preferably, palm pad 2 extends a distance within the range of 50-95% of the lateral width of glove 1 across palm region 7. Such a distance is determined by the length of palm pad 2 at a given location relative to the width of the base glove when laid flat at the same location.

The height 4 of palm pad 2 is pronounced and rises above the base glove by a distance sufficient for the pad material to compress under a compression force, such as when a surfer pushes down to begin the process of transitioning to an upright position. The pad material should compress so as to absorb that energy and then return it to the surfer's hands as the body is propelled up into a standing position. The amount of compression or deformation and the speed of the energy return will depend greatly on the material used in the pad and the amount of force exerted by the surfer, but generally a pad thickness is useful within the range of about 0.5-10 cm, preferably about 1-5 cm, and most preferably a distance within the range of 2-5 cm.

FIG. 2 also shows an embodiment in which a knuckle ridge 12 having second height 13 is positioned on the palm side of glove 1 in knuckle region 8. The knuckle ridge height 13 of knuckle ridge 12 will desirably be less than height 4 of palm pad 2. For example, knuckle ridge 12 may have a knuckle ridge height 13 be 15-65%, preferably 40-60%, of the height 4 of palm pad 2.

Figure 3:
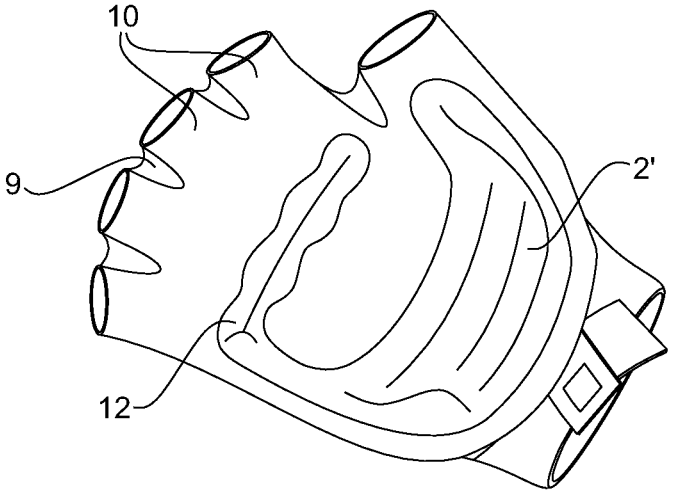
FIG. 3 is a view of another embodiment of a surfing glove according to the invention.

FIG. 3 depicts an embodiment in which palm pad 2' has a substantially consistent thickness across palm region 7 but rounds off sharply to the base glove 3 along the perimeter of pad 2'. Pad 2' may also exhibit a variety of shapes, such as, square-edged, gently rounded mound, tapering on each side, symmetrical, or asymmetrical.

Figure 4:
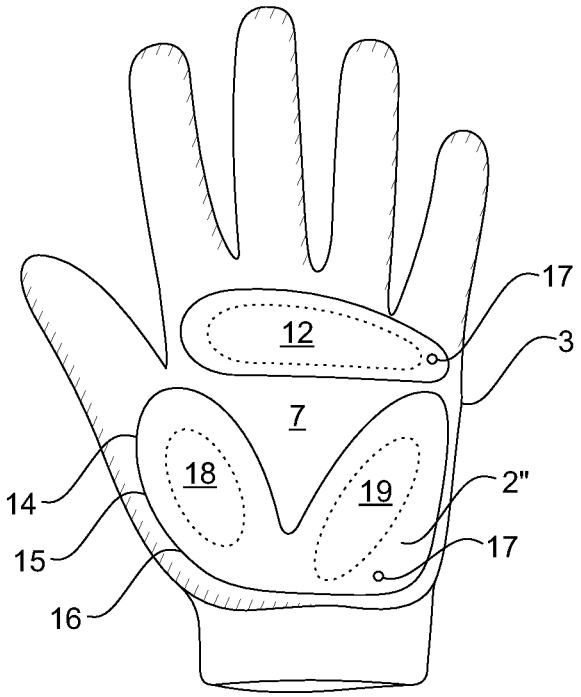
FIG. 4 depicts a view from the palm side of a left hand glove having raised pads over the muscular regions of the lower hand.

FIG. 4 shows a full-fingered glove embodiment having four finger portions and a thumb portion that extend and cover the full length of each finger of the user. In this embodiment, the palm region 7 exhibits a pad 2" that is shaped to provide greater comfort to the user and efficiency in use by a position covering the muscular portions of the lower hand from the base of the thumb to the lateral edge of the hand below the little finger. In medical terms, these are the muscles associated with the thenar pad (thumb muscles) 18 and the hypothenar pad (muscles on the outer edge of the hand) 19. As shown in FIG. 4, such pads could be formed as a pair of connected lobes for the lower pad 2" and a generally rectangular knuckle pad 12 that are positioned over the surfer's hand muscles.

When mounted on the exterior of the base glove 3 around the palm region 7 and made from a resilient material of sufficient height, the surfer can push downwardly while beginning to stand and receive that energy back to the hands as the surfer begins to rise. This provides an assistive boost to help transition to a standing position.

Preferably, the resilient palm pad 2" and knuckle pad 12 are permanently applied to the base glove 3. It is within the scope of the present invention to provide for removable pads 2", 12 that would be secured to the palm region 7 of the base glove 3 with a hook-and-loop fastener form of connection 14. For example, hook portion 15 would be located on the undersides of pad 2", 12 and softer loop portion 16 on top of palm portion 7 facing the underside of pads 2", 12. Such a connection would provide both water resistance and flexure for the base glove with the ability to remove and reposition the pads while floating on a surfboard.

If not made of a solid or foamed material, pad 2" can be an air bladder that is filled with air to provide a degree of resilience that is proportional to the amount of air filled into the bladder. Such an embodiment would benefit from an inflation port 17 that would allow adjustment of the resiliency and boost accorded by pads 2", 12. If formed as a manual inflation nozzle, that resiliency could be adjusted by the surfer on the water between waves.

What is claimed is:

1. A method for aiding a user in transitioning from a prone position to a standing position while the user is surfing while wearing a surfing glove having a palm side with a centrally-located palm region and a complementary exterior side, said glove comprising a resilient, deformable pad rising 1-10 cm above a thenar pad and hypothenar pad regions of the glove, said method comprising: (a) exerting a compressive force on the resilient, deformable pad on the surfing glove that is worn by the user against an upper surface of a surf board to store potential energy in said resilient, deformable pad, and then (b) releasing said compressive force so as to allow said resilient, deformable pad to rebound and release said potential energy for assisting the user to rise and help propel said user into the standing position.

2. A method according to claim 1 wherein said resilient, deformable pad is carried by said user on a glove secured over each hand.

3. A method according to claim 1 wherein said resilient, deformable pad is made from closed cell foam, an elastomer, or an air bladder.

4. A method according to claim 1 wherein said resilient deformable pad is removably connected to said glove with a hook-and-loop fastener connection.

5. A method according to claim 1 wherein said pad extends a distance within the range of 50-95% of a lateral width of said glove.

* * * * *